United States Patent [19]

Leach

[11] 4,040,771

[45] Aug. 9, 1977

[54] LINE RELAY VALVE

[75] Inventor: Paul A. Leach, Jaffrey, N.H.

[73] Assignee: Jaffrey Fire Protection Company, Inc., Jaffrey, N.H.

[21] Appl. No.: 686,452

[22] Filed: May 14, 1976

[51] Int. Cl.[2] ..... E03B 5/00

[52] U.S. Cl. ..... 417/62; 137/566; 137/567

[58] Field of Search ..... 137/566, 567, 608, 610; 417/62

[56] References Cited

U.S. PATENT DOCUMENTS

| | | | |
|---|---|---|---|
| 1,049,894 | 1/1913 | Merrill | 417/62 |
| 1,523,342 | 1/1925 | Hart | 417/62 |
| 2,134,409 | 10/1938 | Kirgan | 417/62 X |
| 2,265,650 | 12/1941 | Lannert | 137/567 |
| 3,073,453 | 1/1963 | Canetta et al. | 137/567 X |
| 3,801,224 | 4/1974 | Eberhardt | 417/62 |

*Primary Examiner*—William R. Cline
*Attorney, Agent, or Firm*—Pearson & Pearson

[57] ABSTRACT

A line relay valve has a valve body with a straight trunk which connects a movable pump to a fire extinguishing nozzle. When the hose lay is several thousand feet, causing severe pressure loss, a first angular branch of the trunk, with a gate valve, is connected to the influent side of a movable booster pump. A second angular branch is connected to the effluent side of the booster pump. Upon opening the gate valve, a clapper swings from first branch blocking position to trunk blocking position to interpose the booster into the system without air intake or water interruption.

8 Claims, 5 Drawing Figures

LINE RELAY VALVE

BACKGROUND OF THE INVENTION

In modern fire fighting systems, it is still the custom, for example, in fighting a fire several thousand feet from a hydrant, to drop a distributor ball valve at the fire and start laying a four inch hose line from the fire to the source of water which may be a hydrant or a pond. The hydrant may be a 600 gallon per minute, 60 psi type which will be reduced to about 350 gallons per minute at the fire due to line loss, friction, etc. If a Siamese valve is interposed in the lay, a fire engine pump may be used to supplement hydrant pressure, thereby providing 150 psi and increasing the flow at the fire to 600 gallons per minute.

If it becomes necessary to tie in a second fire engine pump, it has been necessary to shut down the flow while another Siamese valve is interposed in the line thereby taking in air which may cause air hammer or cause the first pump to fail and permitting the fire to develop during the down time.

In various fixed pumped installations, there have been manual valve systems which permit one pump to boost a second pump as in U.S. Pat. No. 1,523,342 to Hart of Jan. 13, 1925, wherein the flow is reversible. Similarly, in U.S. Pat. No. 2,134,409 to Kirgan of Oct. 25, 1938, a refrigeration system, with a pair of pumps affixed on a compressor tank, includes a manual valve system for by-passing one of the condensers, the pair of clappers being manually moved by knobs.

As far as I am aware, no previous valve systems have been suggested for use in portable, vehicular fire engine equipment wherein a valve coupled into an elongated flexible hose lay, can be used for quick attachment of a booster pump without air intake, or flow interruption, to compensate for loss of pressure and to provide increased pressure.

SUMMARY OF THE INVENTION

In this invention, a line relay valve is provided which can be coupled into an elongated hose lay at a desirable intermediate point depending on elevation and length of the lay. If a booster pump is not needed, the valve simply conducts the flow through a straight tubular trunk without affecting pressure or gallons per minute.

However, the generally Z-shaped line relay valve has a first tubular branch inclined into the trunk, near its effluent end, into which flow is blocked by a single clapper valve being seated in a branch seat when water flows unidirectionally through the trunk toward the fire. The line relay valve has a second tubular branch inclined into the trunk near its influent end, into which flow is blocked by a manually operable normally closed gate valve.

When the pressure drop in the lay requires a boost in pressure, for example, to produce 100 gallons per minute at the fire, or to compensate for frictional line loss, the pump of another fire engine vehicle is quickly connected to the line relay valve, by coupling the influent hose of the pump to the second branch and the effluent hose of the pump to the first branch.

An automatic air bleeder valve in the first branch is normally open to release any air in the system and is closed automatically when the manual gate valve in the second branch is opened. The flow from the original pump is automatically diverted from its original straight path through the trunk by the automatic pivoting of the clapper valve away from its normal position blocking the first branch into its alternate, identical trunk seat, blocking flow through the effluent portion of the trunk. Thus the original pump flow is bypassed through the booster pump for greatly increased pressure which in turn keeps the clapper firmly in closed position in its trunk seat.

DESCRIPTION OF THE PREFERRED EMBODIMENT

Figure 1:
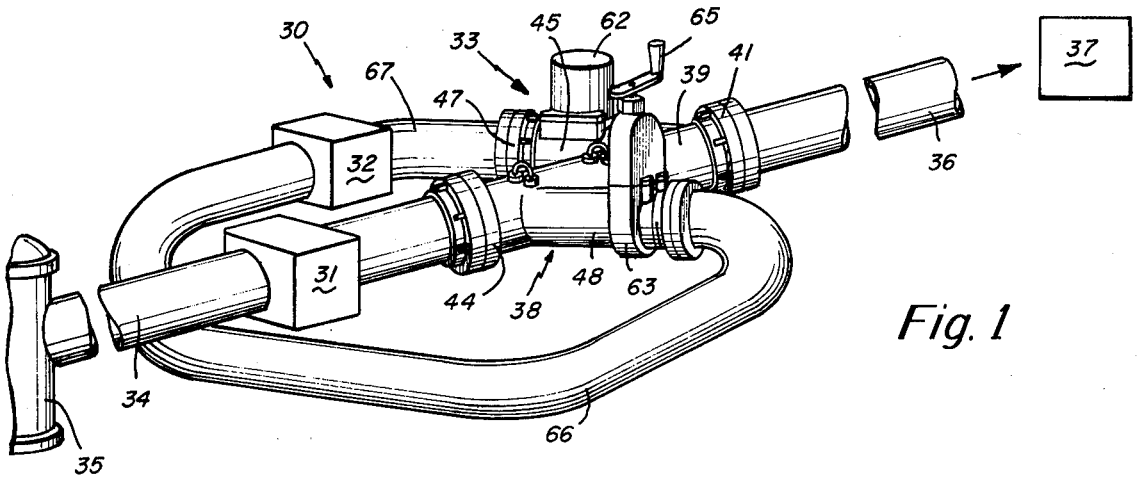
FIG. 1 is a diagrammatic, perspective view of the line relay valve of the invention interposed in an elongated lay or hose.

As shown in the drawings, a typical high volume water system 30, such as used by municipal fire departments for fighting fires at a distance from the fire station, usually includes at least one fire engine vehicle having a motorized pump 31, hose trucks carrying lengths of hose about 4 inches in diameter, and at least one additional fire engine vehicle having a motorized pump 32.

In FIG. 1, the line relay valve 33 of the invention is shown installed in such a system, the portable, or vehicular, pump 31 having an elongated influent, flexible hose connection 34 to a hydrant, or pond, 35 and an elongated effluent flexible hose connection 36, to the fire 37. When the length of the connection 34 and 36 is 1,000 feet or more, the friction of the hose walls tends to unduly reduce the gallons of water per minute from 600 at the hydrant to 350 at the fire. The effect of the first pump 31, when installed in the hose lay at the hydrant, and with an engine pressure of 150 psi is to again achieve a flow of 600 gallons per minute at the fire. A second pump in the line would probably increase the flow to 700 gallons per minute at the fire and a third pump in the line would increase the flow at the fire to 800–1000 gallons per minute.

It is to enable the booster pumps to be used in the line without flow interruption and without creating air hammering in the first pump, that one, or more, line relay valves 33 are included at appropriate locations in the line.

The line relay valve 33 includes a unitary body 38, of generally Z-shaped configuration, having a straight tubular trunk 39 with an effluent end 41 containing a first hose coupling 42 and an influent end 43 containing a second hose coupling 44. The body 38 includes a first, integral, tubular branch 45 angled to the trunk 39 proximate trunk effluent end 41 and having a free terminal, or branch, influent end 46 containing a third hose coupling 47. The body 38 also includes a second, integral, tubular branch 48 angled to the trunk 39 proximate trunk influent end 43 and having a branch effluent end 49 containing a fourth hose coupling 59.

Figure 2:
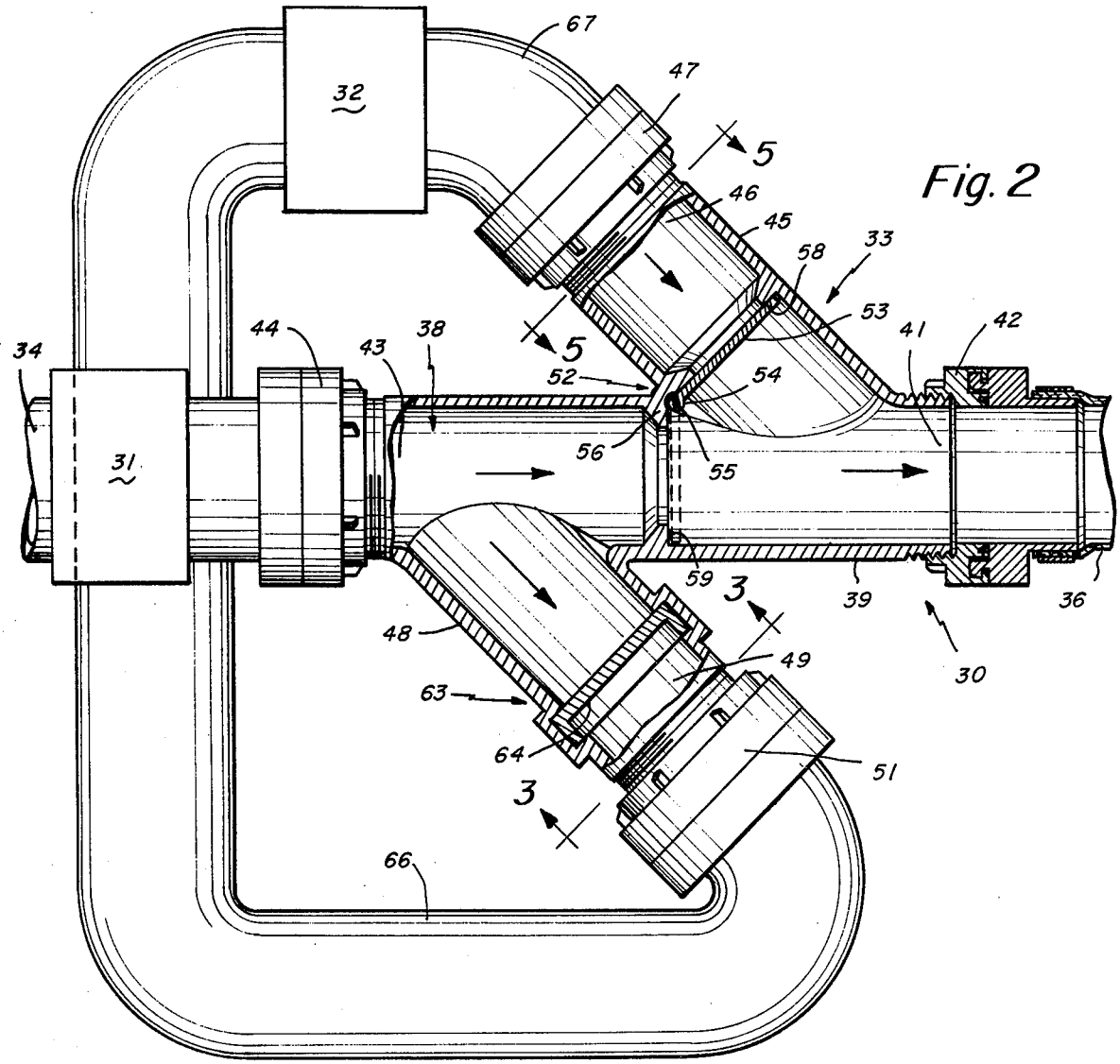
FIG. 2 is an enlarged top plan view of the line relay valve with parts in section.
Figure 3:
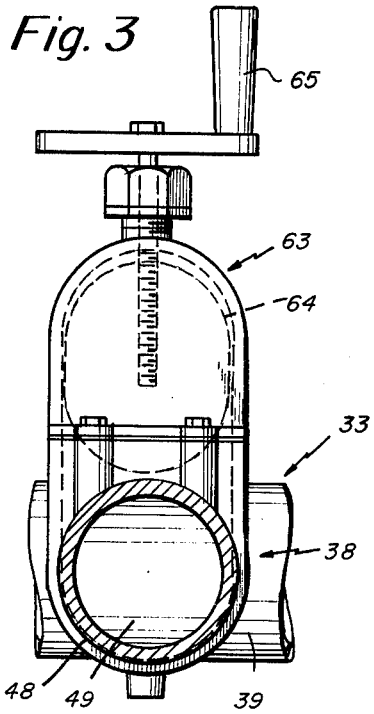
FIG. 3 is an end elevation on line 3—3 of FIG. 2 showing the manual gate valve on the second branch.
Figure 4:
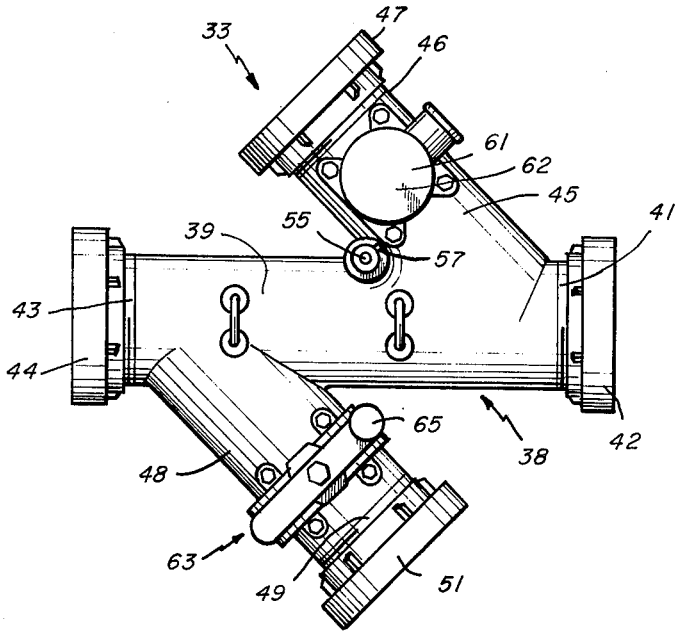
FIG. 4 is a top plan view similar to FIG. 2, but on a reduced scale.
Figure 5:
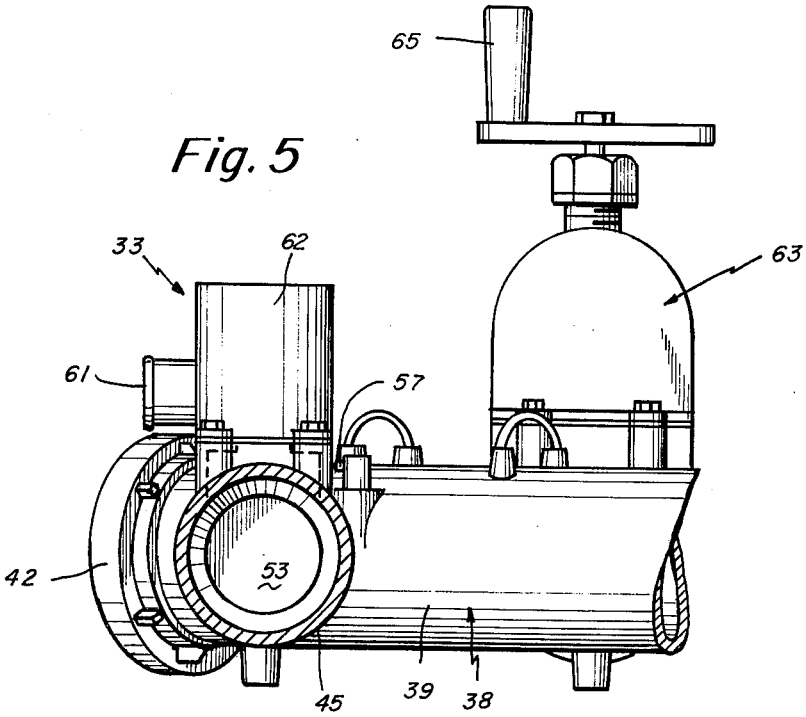
FIG. 5 is an end elevation on line 5—5 of FIG. 2 showing the air bleeder valve and the pressure relief valve on the first branch of the valve.

The first tubular branch 45 as best shown in FIG. 2, includes automatically operable valve means 52 in the form of a clapper 53 pivoted at 54 by a shaft 55 in valve body 39 at the junction 56 of trunk 39 and branch 45. Shaft 55 extends outside of body 39 and terminates in a pointer 57 which visually indicates whether the clapper 53 is normally closing the branch valve seat 58 or is closing the identical trunk valve seat 59.

The first tubular branch 45 preferably also includes an air bleeder valve 61 and a pressure relief valve 62, both of known type.

The second tubular branch 48 includes a manually operable gate valve 63 having a gate 64 and a handle 65, the gate 64 being normally closed to block flow from the trunk 39 out of the branch 48.

As explained above, the line relay valve 33 is interposed in the hose line 36 leading from pump 31 to the fire 37, with manual gate valve 63 normally closed and clapper 53 normally moved by line pressure to closed position on branch seat 58. Thus flow is straight through trunk 39 from trunk influent end 43 to trunk effluent end 41. When increased flow proves necessary or desirable, a fire engine pumper 32 is moved to line relay valve 33 and the influent hose 66 of pump 32 is connected to the branch effluent end 49 of second branch 48 by fourth hose coupling 51. The effluent hose 67 of pump 32 is connected to the branch influent end 46 of first branch 45 by third hose coupling 47 to complete the booster system. The air bleeder valve 61, located within pressure relief valve 62 is opened automatically to bleed any air and then is automatically closed. The pump 32 then being in operation, the manual gate valve 63 has its gate 64 opened to by-pass the flow from pumper, 31, into branch 48, hose 66, pump 32, hose 67 and first branch 45. The increased pressure from both pumps in tandem then automatically swings clapper 53 to open branch valve seat 58 and close trunk valve seat 59, thereby boosting the gallons per minute at the fire, without creating air hammer, with no interruption of flow, and with no down time of the system. The pressure relief valve 62 is set to dump the system at a predetermined pressure, usually 150 psi.

I claim:

1. In a fire fighting system of the type having a first portable pumper with an elongated influent flexible hose for connection to a distant source of water and an effluent flexible hose for directing said water onto a fire, the combination of line relay valve means, said means comprising:

a generally Z-shaped, unitary valve body having a straight tubular trunk with a first hose coupling at trunk effluent end and a second hose coupling at a trunk influent end, a first tubular branch angled to said trunk proximate said trunk effluent end and having a third hose coupling at a first branch influent end and a second tubular branch angled to said trunk proximate said trunk influent end and having a fourth hose coupling at second branch effluent end;

automatically operable valve means comprising a valve seat in said first branch, an identical valve seat in said trunk and a clapper pivoted to said body to swing from one said seat to the other for blocking flow through said branch or said trunk;

a manually operable gate valve in said second branch for blocking flow therethrough when closed;

and a second portable pumper with an influent flexible hose coupled to said third hose coupling whereby opening said gate valve and operation of said second pumper causes said clapper to swing to close the said seat in said trunk to by-pass the water from said first pumper through said second pumper and thence through said first branch to said effluent hose.

2. A fire fighting system as specified in claim 1 wherein:

said valve body includes an automatic air bleeder valve on said first branch in advance of the said valve seat therein, for removing air from said system prior to opening said gate valve.

3. A line relay valve for enabling a second pump to be interposed in an elongated fire hose lay to compensate for hose friction loss of pressure from a first pump, said valve comprising:

a unitary valve body having a main trunk with a first hose coupling at the trunk influent end and a second hose coupling at the trunk effluent end;

a first branch angled away from the effluent end of said trunk and having a first branch influent end with a third hose coupling thereon;

a second branch angled away from the influent end of said trunk and having a second branch effluent end with a fourth hose coupling thereon;

an automatically operable clapper pivoted at the junction of said first branch and said trunk to swing from a first branch seat blocking flow through said branch to a trunk seat blocking flow through said trunk;

and a manually operable gate valve in said second branch for controlling flow therethrough;

whereby said first pump may be connected to the influent end of said trunk, an effluent hose may be connected to the effluent end of said trunk, said second pumper may be connected to pump from the effluent end of said second branch into the influent end of said first branch and said gate valve opened to cause increased pressure to swing said clapper to closed position in said trunk.

4. A fire fighting system of the type having an elongated lay of hose from a waater supply to a fire, a main vehicular pump for creating water pressure in said hose and a booster vehicular pump for creating increased water pressure in said hose to compensate for friction loss said system characterized by a line relay valve means comprising:

a Z-shaped valve body having an open-ended, tubular, straight trunk and a pair of tubular branches, oppositely angled thereinto, each with an open end;

an automatically operable clapper valve in one said branch, mounted to swing from a position closing said branch to a position closing said trunk;

a manually operable gate valve in the other said branch for controlling flow therethrough one end of said trunk being connectable with said water supply, the other end of said trunk being connectable to the hose leading to said fire, the end of said second branch being connectable to the influent side of said booster pump and the end of said first branch being connectable to the effluent side of said booster pump;

whereby said main pump creates water pressure when said gate is closed but both said pumps create water pressure when said gate is opened.

5. A system as specified in claim 4 plus:

a pressure relief valve, set at about 150 psi, mounted in said first branch.

6. A system as specified in claim 4 plus:

an air bleeder valve mounted in said first branch for bleeding said system of air bubbles as the gate valve is manually opened.

7. A system as specified in claim 4 plus:

a pointer on the exterior of said valve body operably connected to said clapper valve for visually indicating the position of the clapper of said valve.

8. A system as specified in claim 4 plus:

a quick acting, quarter turn coupling on each end of said trunk and said branches for enabling said booster pump to be interposed in said system without undue loss of time.

* * * * *